United States Patent [19]

Thayer

[11] 4,127,766

[45] Nov. 28, 1978

[54] AUTOMATIC AND ACCURATE PASSENGER COUNTER WITH STORAGE AND RETRIEVAL

[76] Inventor: Stephen C. Thayer, Lewistown, Pa.

[21] Appl. No.: 792,051

[22] Filed: Apr. 28, 1977

Related U.S. Application Data

[63] Continuation-in-part of Ser. No. 674,037, Apr. 5, 1976, abandoned.

[51] Int. Cl.[2] ..... G07C 9/00

[52] U.S. Cl. ..... 235/92 PK; 235/92 CA; 235/92 V; 235/92 R; 235/98 C; 340/674

[58] Field of Search ..... 235/92 PK, 92 V, 92 CA, 235/92 MS, 92 TC, 92 ST, 98 C, 98 R; 340/258 B; 250/221

[56] References Cited

U.S. PATENT DOCUMENTS

| | | | |
|---|---|---|---|
| 3,036,219 | 5/1962 | Thompson | 340/258 B |
| 3,378,675 | 4/1968 | Cromley | 235/92 MS |
| 3,692,980 | 9/1972 | Getker et al. | 235/92 V |
| 3,727,034 | 4/1973 | Pope | 235/92 ST |
| 3,808,410 | 4/1974 | Schlesinger | 235/92 T |
| 3,840,868 | 10/1974 | Campman | 340/258 B |
| 3,970,846 | 7/1976 | Schofield | 340/258 B |
| 4,000,400 | 12/1976 | Elder | 235/92 PK |
| 4,009,389 | 2/1977 | Lindholm | 340/258 B |

*Primary Examiner*—Joseph M. Thesz
*Attorney, Agent, or Firm*—Woodcock, Washburn, Kurtz & Mackiewicz

[57] ABSTRACT

Disclosed is an apparatus for determining the number of moving objects which completely traverse a given path. The apparatus provides an array of light sensors which are placed adjacent the path. A scanner periodically samples the output of each sensor in the array and produces an output proportional to the ambient light in the path striking the sensor. This output is stored for comparison with future outputs so that changes in the ambient light in the path may be detected. Changes in ambient light at a particular sensor are compared with changes detected by adjacent sensors, first to prevent erroneous readouts and second to determine the direction of movement. Moving objects completely traversing the field are recorded.

9 Claims, 5 Drawing Figures

AUTOMATIC AND ACCURATE PASSENGER COUNTER WITH STORAGE AND RETRIEVAL

This application is a continuation-in-part of application Ser. No. 674,037 filed Apr. 5, 1976, now abandoned.

BACKGROUND OF THE INVENTION

Many attempts have been made to construct apparatus to accurately count passengers boarding and alighting buses and other transit vehicles by the method of: (1) determining the direction of movement of the person and (2) determining whether the entrance or exit operation was completed or aborted. Several methods have incorporated various types of switches into at least two of the consecutive step treads of the transit vehicle to sense the weight transmitted to them by passengers' feet. The sequences of closings and openings of these switches are analyzed by various forms of logic to determine both the direction of flow and the completion of the boarding or alighting operation. These switches are subjected to (1) millions of flexures in the course of use on a mass transit vehicle, and (2) environmental conditions such as moisture, snow and ice, dirt and dust, extreme fluctuations in temperature with door openings and changes in the seasons and weather, which all affect the life and the operation of the switches. Further problems result from wear of the tread surface which reduces the practicality of treadle switches even though the cost of these units is potentially low.

Other methods involve infrared or visible light sources and sensors with multiple light beams directed horizontally across an entrance or exit portal to detect both movement and completion of an event when these beams are interrupted in sequence by parts of the passenger's body. These methods suffer from the disadvantages of uncertainty of count produced as the result of interruptions by canes, umbrellas, coat sleeves, and other spurious objects which may also traverse the path and interrupt the beam in other than the desired sequences. These methods have the advantages that weather and atmospheric conditions are less detrimental than for treadle switches and the sensors usually exhibit longer life-times than treadle switches.

A third method uses ultrasonic sound waves transmitted either across the portal or out into the portal with detection by an ultrasonic receiver. Detection of parts of passengers' bodies are made by either interrupting the ultrasonic beam, keeping it from being sensed by an ultrasonic receiver, or by the reflection of the beam into a sensor by parts of the passenger's body. A modification of this method senses the reflection of a short pulse of ultrasound into a sensor sooner by an "observed" object that is closer to the ultrasound receiver than the opposite wall of the step well that normally reflects the pulse into the receiver in a given constant length of time when no object is present. The disadvantages of the method are that absorbing or deflecting materials such as clothing may either prohibit reflection of the beam or may reflect it in another direction so that it is not sensed by the sensor thus confounding the operation of the unit.

These and other methods may be found in a report: M74-86 Oct. 1974, prepared by the Mitre Corporation for the Urban Mass Transportation Administration (UMTA), and in a final report of the results of a study of these methods also prepared by the Mitre Corporation for UMTA. All of these methods are inaccurate as the result of the ambiguity in the meaning of the output of each sensor with respect to the output of the other sensors. The requirements placed on the logic to analyze a reasonable number of sensor outputs and convert them into meaningful outcome with respect to the direction and completion of the events is almost impossible because each output from a sensor may have more than one significance. For example, persons standing on the stairs will cause a constant output from one or more sensors and will most certainly prevent the detection of persons passing by them either on or off. Also persons moving back and forth such as a feeble person who is having trouble negotiating the stairs or a person asking a question of the driver will, in most cases, give an indication of either no count or multiple counts in both directions. Furthermore, persons crowding on or off the vehicle may confuse the logic by generating sensor outputs in a large variety of sequences and patterns which may have multiple meanings or no meaning at all. These problems in logic related to a reasonable device of reasonable complexity may be found in the Mitre Corporation report, MTR-7071, of the test of various methods of automatically counting boarding and alighting persons on transit vehicles.

It may be further pointed out that with the exception of treadle switches, which have their own problems including that of liability as the result of possible falls from tripping, all of the other counting methods described require the use of beams of radiation of some sort in order to detect the presence of passengers or objects. The required use of a beam is a drawback in itself in that failure or partial impairment of the source of one or more beams jeopardizes the ability of the device to detect and count objects. Blockages of one or more beams, such as with a hand, piece of clothing or object standing in front of them has the same effect. Effects that cause dimming or brightening of the beams, or ambient sources of radiation of the same type that penetrate into one or more of the sensors to the extent of masking, saturating, or in other words decreasing the sensors' ability to distinguish the directed beam from the ambient, impair the ability of the device to detect and count objects.

SUMMARY OF THE INVENTION

Accordingly an object of this invention is to accurately count objects or persons moving into or out of or moving within a field of determination as well as to determine the direction of motion and the completion of each motion sequence of these objects.

A further object of this invention is to accurately determine the number of objects or persons remaining or standing in an area such as the entrance area of a public transport vehicle or passengers moving around them.

Further objects of this invention are to accomplish the above two objects with a device that has long life, will not be deteriorated by the presence or movement of the counted objects, is unobtrusive, and does not deteriorate the environment nor detrimentally alter it by its presence, operation, or use, and which is essentially unaffected by weather or environmental conditions.

Further, it is an object of the present invention to provide a device giving an accurate count under a very wide range of ambient light conditions.

A further object of the present invention is to accomplish the above objects without requiring the use of beams as for example, visible, ultraviolet, or infrared light, or ultrasonics in order to accomplish the act of counting or observation.

A further object of the present invention is to provide a system that will record the information obtained by the device that satisfied the above objects along with other information received from other sources such as odometers, keyboards, and alpha-numeric and analog data sources such as temperature and oil pressure, sensor/transducers etc. Further the recording or storing of this information is in an inexpensive, convenient, easily transportable and easily retrievable form which is capable of recording or storing this information over long periods of time such as major portions of a day without the need for attention or service.

A further object of the present invention is to accomplish all of the above objects with a compact, easily portable, practical system which can be easily stored for use inobtrusively and further to provide a system which is inexpensive to obtain, operate and maintain.

In accordance with the above objects the present invention comprises a means for detecting the presence and movement of objects or persons as well as accurately determining the direction and the completion of the movements or events. In accordance with this invention there is provided an array of sensors passively detecting the presence of objects without direct contact with the objects or without directing light or sonic beams at the objects to determine their presence. Once the presence of the objects or objects is detected by the sensors, motion is determined by the changes of the output conditions of the sensors in a logical sequence with respect to the position of the sensors in the array. Logic elements such as are found in mini or micro-computers or processors are used to analyze the changes in sensor outputs to determine movement as well as the entrance and exit of discrete objects into or out of various edges of the field of determination of the sensor array in order to ascertain the completion and direction of movement of the entrance or exit operation.

Further in accordance with this invention there is provided a system of logic, memory and recording means to record or store the information obtained from the sensor arrays along with other information such as starting time, date, bus number, route number, block number, time of day, load, odometer readings, door openings, oil pressure and engine temperature readings, and information provided from keyboards and other sources either digital or analog.

Alternately various modifications of the present invention may be utilized to monitor movement of people or objects into or out of secured areas such as buildings, sporting events, airplanes, etc.

DESCRIPTION OF THE PREFERRED EMBODIMENTS

Figure 1:
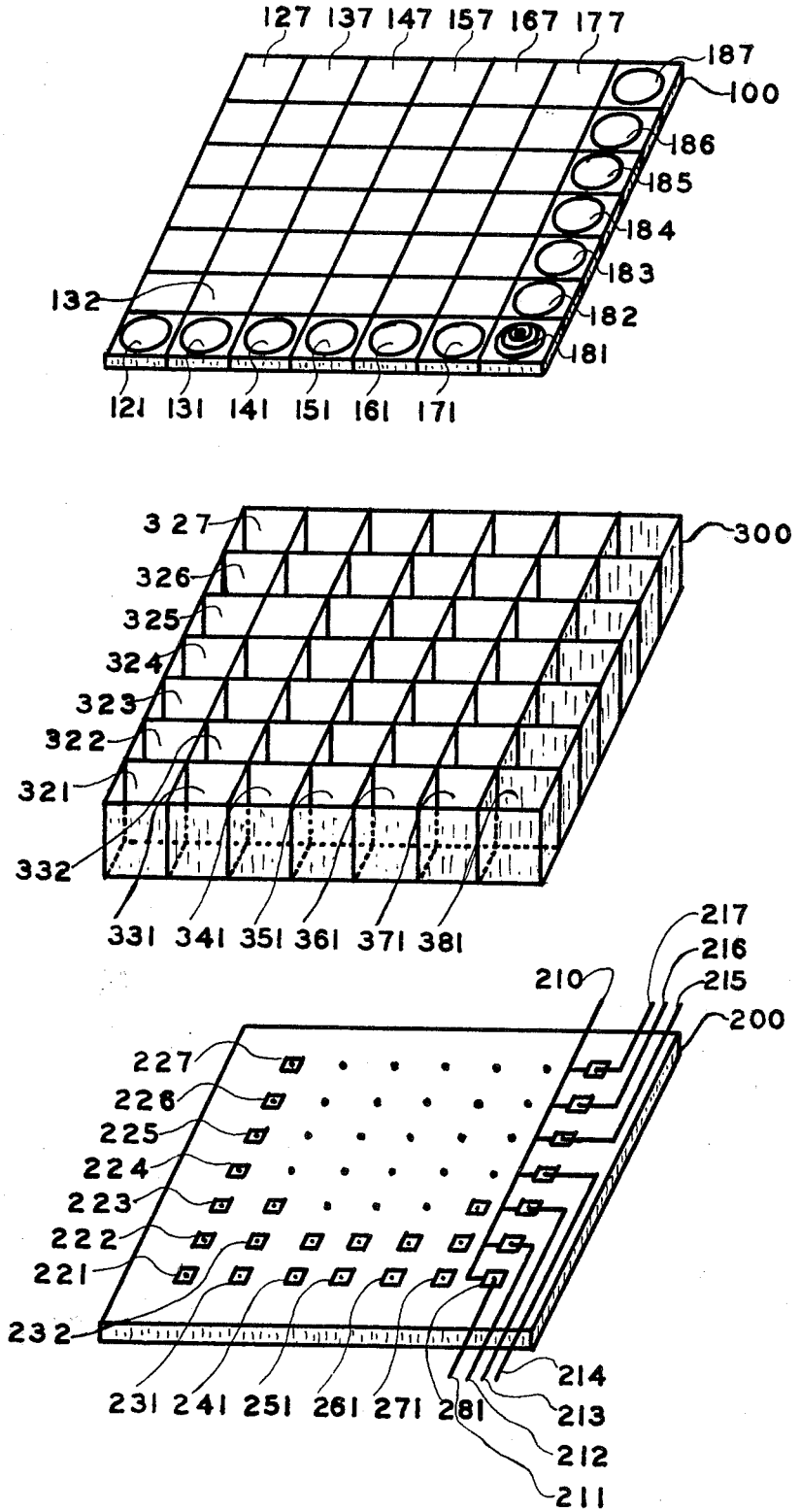
FIG. 1 is an exploded view of the sensor unit used to determine the presence and movement of objects in a field of determination in accordance with one or more of the objects of this invention.

Referring to FIG. 1, an embodiment of a sensor unit is illustrated in an exploded view. In accordance with the present invention an array 100 of lenses 121–127, 131–137, etc. through 181–187 are used to concentrate ambient light from a field of determination 500 of FIG. 2, onto separate sensors 221–227, 231–237, etc. through 281–287 arranged in an array 200 related to the array of lenses in such a manner that discrete areas of the field of determination 500 are focused by the lenses onto their corresponding sensors. For example, lens 121 would focus a corner area of the field of determination onto sensors 221. A cellular collimating spacer array 300 consisting of cells 321–327, 331–337, etc. through 381–387 is used to (1) position the lenses the proper distance from the sensor elements so that light from the plain of interest 600 (FIG. 2) within the field of determination 500 will be focused on the sensors, and (2) insure a one-to-one relationship between each lens and its corresponding sensor. For example, the vertical walls of cell 332 prevent the light passing through lens 132 from reaching sensors 222, 233, 242, 231, i.e., the nearest neighbors or sensors 221, 223, 243, 241, i.e., the next nearest neighbors. The cell walls should be generally absorbing of light so as to prevent light originating from other than the desired object area of the lens from being reflected off the walls of the cell into the sensor.

Connections are made to the sensors, in this case photo-darlington amplifiers, by conductors 210, shown here being common to all sensors in one column, and by at least one other connection to each sensor as represented by connectors 211–217, in the column comprised of sensors 281–287. It may be understood that each sensor may be connected individually by two separate connections or connected in any fashion of common connection requiring only that information of the light level reaching each sensor may be obtained independently from every other sensor. For example, a cross matrix connection is possible so that individual sensors in the array could be polled at different times by making the appropriate external connections to the desired "x" and "y" common "buss" connections that intersect at the sensor to be polled. Connector 210 of FIG. 2 represents a common "x buss" connection to column 281–287.

Figure 2:
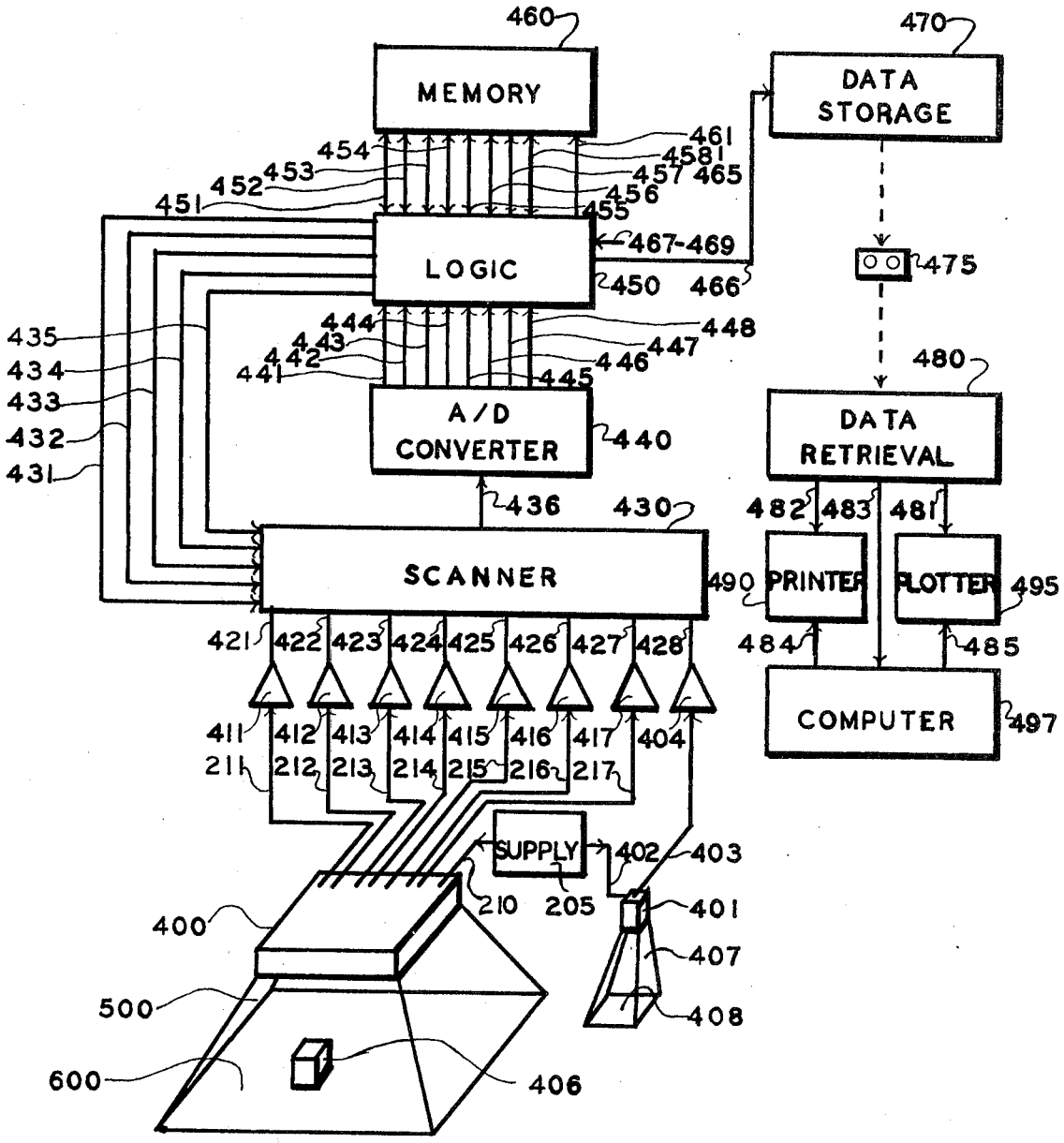
FIG. 2 is a block diagram representing the entire system of this invention showing the various parts of the system required to make the invention operative.

One part of FIG. 2 depicts the assembled sensor unit 400 made up of the elements depicted in FIG. 1, i.e., the lens array 100, the sensor array 200, and the spacer array 300 assembled in a compact unit 400, with the sensor array 200 being uppermost and the lens array 100 being lowermost. As depicted in FIG. 2 the sensor unit 400 receives light from the field of determination 500. The sensors are connected to a voltage or current supply by a common connection represented here by conductor 210. Individual sensor connections represented by conductors 211–217 are connected to amplifiers 411–417 which amplify the output of the sensors to usable levels. Conductors 421–427 connect the amplifier outputs to a scanner or multiplexer 430 which individually connects each of the sensor outputs of the array of sensors of unit 400 to a single output conductor 436 at different periods of time. Auxiliary sensor 401, which may be part of the sensor array 400, is used as control element to be described later.

The output of the scanner 430 is connected by conductor 436 to an analog-to-digital converter 440 that converts the signal representing the quantity of light reaching each sensor into a digital representation of that light level and outputs that information by parallel conductors 441–448. The digital representations of the light levels of each sensor are received by a logic module 450 sequentially in time as controlled by control lines 431–435, thus controlling the multiplexer or scanner 430. The logic module 450 can direct the storage of each digital representation of sensor output, including that of the control sensor 401, into a memory bank 460 through conductors 451–458 and by control lines 461–465. The logic block 450 analyzes the digital representations of the levels from the sensors in a way to be described later and produces results of the interrogation that is transferred by conductor 466 to a data storage module 470 for later retriveal. The communication between the logic block 450 and the data storage module 470 is preferably by a condcutor 466, however light, radio or other form of communcation could also be employed. Additional data inputs represented by conductors 467–469 for example, data regarding the time of starting and stopping of the bus, etc., may also be stored or recorded by the data storage module 470. Optionally other sources of data such as oil pressure, engine temperature, fuel level, outside temperature, time of day and information pertaining to the operation of the bus, etc., may be inputted through these additional data inputs for storage.

Additionally provided is a data retrieval unit 480 that receives the stored data in a convenient transportable form 475 such as magnetic tape cartridges or cassettes and converts this data into usable outputs via conductors 481, 482, and 483 to peripheral devices such as a printer 490, plotter 495, or a computer 497 which reproduces the data in an easily understandable form.

For purposes of this discussion an area of determination is that portion of the field of determination 500 observed by one sensor/lens unit, such as that shown at 407 in FIG. 2.

Operation of the sensor counter depicted in FIGS. 1 and 2 is as follows, logic unit 450 addresses and interrogates each sensor in sensor unit 400 sequentially and cyclically with a cycle time short enough that an object 406 would remain in an area of determination while the corresponding sensor for that area is "polled" many times during subsequent cycles. Starting from a condition of no objects being within the field of determination 500, all sensors are "polled" at least once to determine the ambient levels of light reaching the sensor. This level is then the "normal" to each area of determination when unoccupied. These light levels are converted to digital form in turn by the scanner/multiplexer 430 and the analog-to-digital converter 400 and then the digital values are stored in separate locations in the memory 460. Sequencing of the "polling" conversion and storage is controlled by control lines 431–435 and 461–465 respectively. The manner in which a scanning or multiplexing voltage is applied to these lines is well known. Upon subsequent cycles of the interrogation scan throughout the sensor array the "present" light levels arriving at each sensor are compared by logic block 450 with the "normal" or unoccupied values for that sensor that was stored in memory 460 on the first scan. A change in light level arriving at any sensor larger than a preset value either greater or lesser postulates the presence of an object in that sensor area of determination. Subsequent interrogation scans through the sensor array and comparisons with the normal values in memory, confirms the presence of the object. As the object moves in the field of determination, the logic unit by comparing stored "normal" or "unoccupied" values with the "present" values of light levels arriving at each sensor follows the movement of the observed objects by noting successive changes of light levels of approximately the same amount in a sequential manner in adjacent sensors.

Completion of events is determined when the logic module notes that an object has moved in such a way that it finally exits through a defined edge or boundary of the field of determination. For example, on a transit vehicle objects would have to enter or exit the field of determination via a path having a first and second boundary corresponding in position to the door portal and to the entrance to the center aisle of the vehicle. An object entering the field of determination through the "door" portion of the boundary and eventually leaving the field of determination through the center aisle portion of the boundary would be determined by the logic module to be one boarding passenger or event. An object entering and exiting the field of determination in the reverse sequence would be determined to be an alighting event. Objects entering or exiting the field of determination by any other portion of the boundary of the field of determination than those designated as "doors" or "aisle entrance" would in this case be ruled out as being invalid objects or events. Such invalid "objects" considered by the sensor and logic may be caused by spots of light that traverse the field of determination. These spots may be caused by movement of the vehicle and are in almost every case moving at right angles to the direction of motion of passengers. An auxiliary data input such as conductor 467 may be used to inform the logic unit that the vehicle has stopped and the door has opened so that the light information arriving at the sensors can be considered only with respect to a nearly constant set of externally generated conditions, i.e., with the vehicle stationary.

In a preferred embodiment unit 400 would be mounted above the objects looking down into the field of determination as depicted in FIG. 2. As described, the logic unit 450 would periodically determine () the presence and number of objects remaining in the field of determination; (2) the number of objects that have entered and exited in one direction; and (3) the number of objects that have entered and exited in the opposite direction. This information is periodically transmitted to the data storage unit 470 via conductor 466, along with other information periodically acquired on auxiliary data lines represented by conductors 467 through 469, and there recorded in a convenient form for later retrieval. Such recording means could be a magnetic tape recorder or programmable read only memory.

The circuitry comprising the logic block 450 performs three basic functions. First, means are provided for sequentially analyzing data from a uniquely determined sensor location. Secondly, means are provided to prevent erroneous readouts and thirdly, means are provided to determine the origin and direction of movement of objects present in the field of determination 500.

Figure 3:
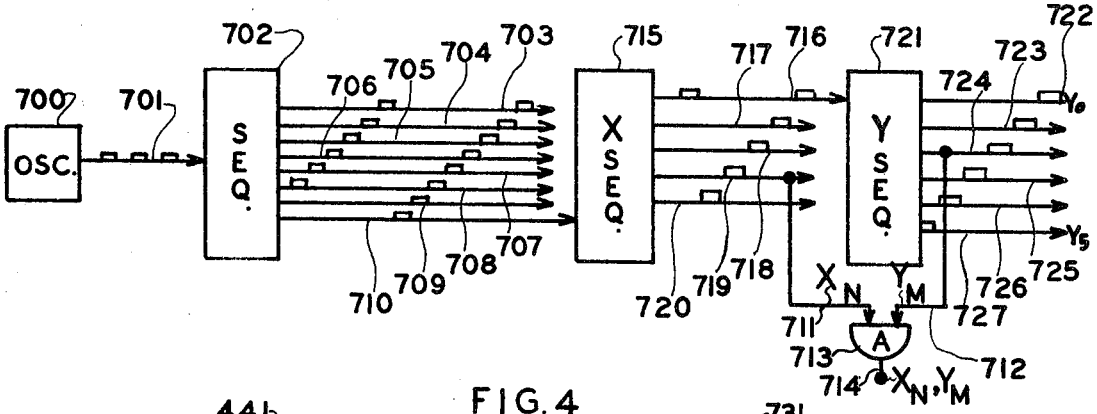
FIGS. 3–5 are circuit diagrams of the logic block and the memory block shown in FIG. 2.

One configuration of the logic block 450 of FIG. 2 may be represented as follows. Means for sequentially analyzing each sensor are provided by an oscillator 700 as shown in FIG. 3. The oscillator provides a pulse train via line 701 to a sequencer 702 that puts out single pulses on separate lines 703–710 sequentially in time such that the sequences of pulses on these lines repeat themselves each time the entire sequence is completed. The last line from sequencer 702, i.e., line 710, is used to input an X sequencer 715 that puts out single pulses on separate lines 716–720 which is used to address various segments of the sensor array and the logic used to interrogate these sensors. The first line 716 is also connected as an input to a Y sequencer 721 which puts out single pulses on separate lines 722–727, also used to address various segments of the sensor array and the logic used to interrogate these sensors. The X lines might address columns in a matrix while the Y lines might address rows of a matrix, though it should be understood that this may only be one of many schemes by which sensors may be arranged or addressed. The one point that is revelant is that one X line and one Y line used in conjunction with each other is sufficient to address a unique place or point in the sensor array and to activate particular circuits in the logic and memory arrays.

One such combination is shown being selected by lines 711, represented as $X_n$, attached to output line 719 of the X sequencer and as an input to the AND gate 713, and line 712, represented as $Y_m$, attached to the output line 724 of the Y sequencer, and also as an input to the AND gate 713, such that the output line 714 of the AND gate goes high when both $X_n$ and $Y_m$, lines 719 and 724, have been selected by the two sequencers. This gives an output unique to $X_n$, $Y_m$. Other such AND gates as 713 would be used to address all other unique points in the system by being attached to the proper combinations of X and Y output lines.

It should be here noted that the length of each pulse on each X line is approximately equal to the entire time required for the sequencer 702 to go entirely through a cycle from lines 703–710 and back to 703. The length of each pulse on each Y line is approximately equal to the entire time required for the X sequencer 715 to go completely through its cycle from line 716–720 and back to 716. Line 722 is here represented as $Y_0$, addressing the DOOR row of sensors and logic, and line 727 is here represented as $Y_5$, addressing the AISLE row of sensors and logic.

Once a particular sensor $X_nY_m$ has been selected for analysis, the A/D converter 440 provides an 8-bit digital representation of the ambient light striking that selected sensor. The output lines 441–448 (FIG. 2) from the A/D converter 440 are then each brought to that portion of the logic block 450 which comprises the aforementioned means to prevent erroneous readout. The means to prevent erroneous readouts further comprise a circuit which insures that an object detected by a particular sensor is significant enough to be recognized and a verification circuit which determines whether the recognized object has also been recognized by neighboring sensors.

Figure 4:
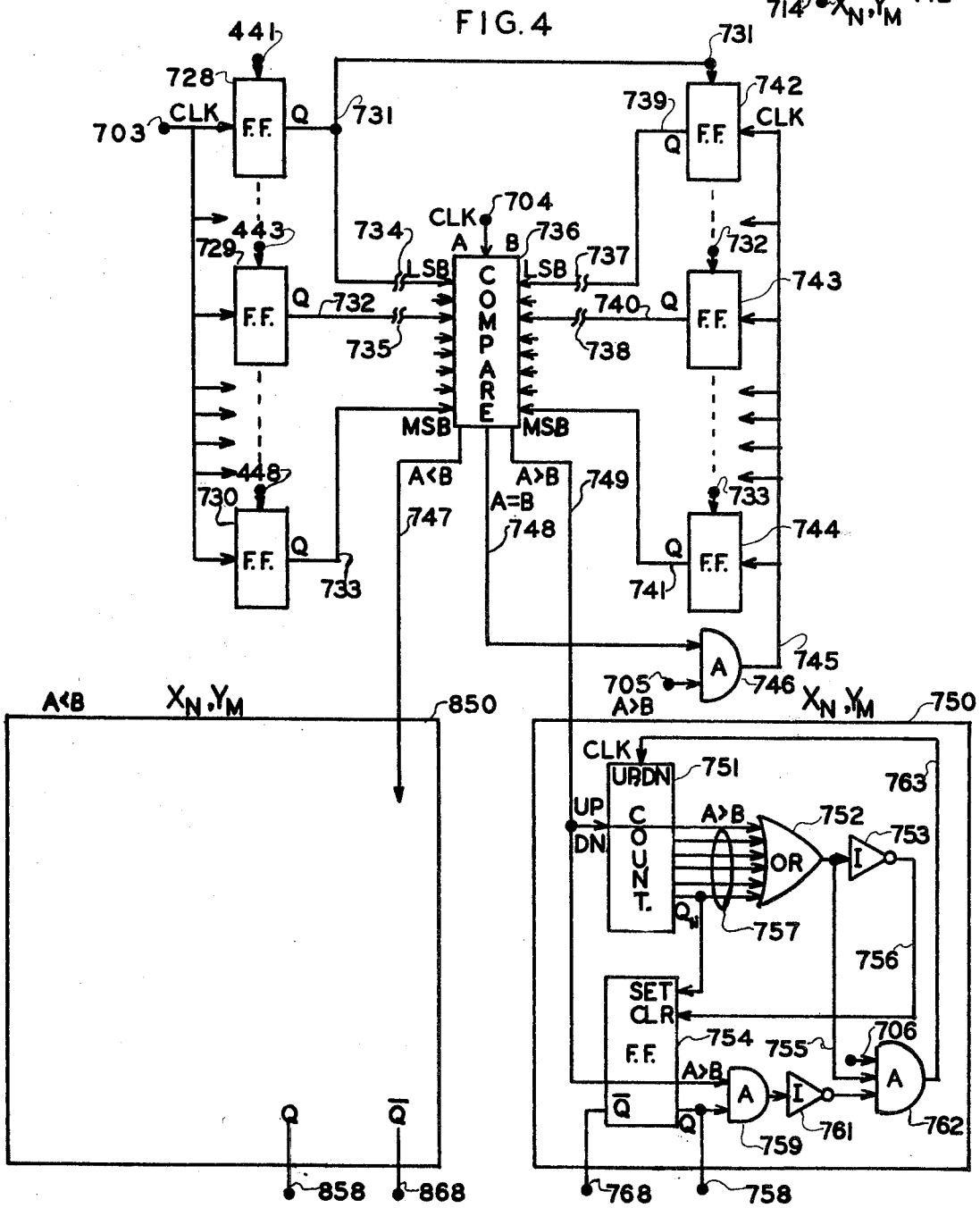

The circuit for determining whether the observed object is significant enough to be recognized could, in one practical example, be constructed as shown in FIG. 4. It should be noted that the circuit shown in FIG. 4 represents only one of many such circuits and in fact there is one such circuit for each particular sensor. The signal appearing at output line 714 which addresses the particular sensor $X_nY_m$ is also used to select the particular circuit such as that shown in FIG. 4

Referring to FIG. 4, the eight output lines of the A/D converter 440 of FIG. 2, lines 441–448, are each brought to the input of a flip-flop, three of which are shown at 728–730 of FIG. 4, which provides the temporary storage of the data. The first pulse in "time" on line 703 from the sequencer latches or sets the data into the flip-flops which are found in the memory 460. The output state for each bit position in the blank of flip-flops 728–730 is conveyed by lines 731-733 to both a comparator 736 which is part of the logic block 450 and to inputs 731–733 of a more permanent storage represented by flip-flops 742–744. This latter storage is for the base line or "recent past" values for the light levels at the sensors. The outputs of the base line storage or "recent past" storage are brought to the same comparator 736 via lines 739–741 to be compared with the "present" value brought by lines 731–733. The pulse on line 704 "clocks" the comparator 736 to determine the difference between the "present" value at the sensor and the "recent past" value at the sensor. The result of the comparison is brought out on lines 747–749 with "present" less than "past" on line 747, "present" greater than "past" on line 749 and "same" on line 748.

Note that there may be breaks in the input lines to the comparator represented by 734–735 and 737–738 for the lower order bits of the data so that only changes of greater than a certain value may be observed by the comparator. This provides a "window" with which to look at the incoming data to eliminate triggering on "noise". If the result of the comparison is within the "window" as being the "same", the "present" values are transferred to the "past" value storage via lines 731–733 through data inputs 731–733 when a pulse arrives on line 745 as controlled by the coincidence of the "same" signal on line 748 and the control pulse on line 705 from the sequencer 702 at the control gate 746 whose output line 745 clocks or sets the flip-flops 742–744.

If the output of the comparison is other than "same", the output is incremented into a counter block 850 for "present" less than "past" or 750 for "present" greater than "past". These counter blocks are found in the memory block 460. These conditions will be herein noted as A<B and A>B respectively. These counter blocks contain up/down counters 751 so that each time the same phenomenon is "seen" at the sensor the counter is incremented up one and each time it is "not seen" the counter is decremented one. Then only when the counter block counts up to a preset value N, will the output of counter block 750 or 850 register via lines 758 or 858. In this way the "seen" change at the sensor has to be self consistent over a "period" of time in order to register as an "object". By the same methods when the "object" is no longer seen, the output will be cancelled. This is described as follows:

One such counter block 750 is shown and its operation explained as follows. The control line A>B or 749 controls the UP/DOWN counter 751 such that when the A>B line 749 is "high" the counter 751 will count up one for each clock pulse it receives and when A>B or line 749 is "low" the counter will count down one with each clock pulse. A>B high means object "seen" and A>B low means object "not seen". The clock pulses are provided by line 706 from sequencer 702 via AND gate 762 and line 763 only when the other two inputs lines to 762 are high.

Now if the A>B line 749 remains high for at least N clock pulses the output lines 757 will give an indication of increasing count until line $Q_n$ is finally set. N represents the preselected number of times the object is to be "seen" before being "recognized". The high on $Q_n$ sets flip-flop 754 giving an output on the Q line 758 and clearing the output on the Q line 768.

At this point it is not desirable to have the counter 751 count higher so as long as the control line A>B, i.e., line 749, is high and the Q line 758 is high, the AND gate 759 and the inverter 761 produce a low on an input to AND gate 762 blocking pulses from 706 passing through to the clock input of 751 on line 763.

When line A>B, i.e. line 749, goes low AND gate 759 and inverter 761 again place a high on an input of AND gate 762 and again allows clock pulses from 706 to pass through to counter 751 if the other input is high. Now since the control line 749 is low the counter 751 counts down. If line A>B, i.e. line 749, remains low for at least N clock pulses the counter will count down until all of the Q output lines 757 of counter 751 have been cleared. Since it is not desirable to count down lower than this, when all of the inputs to the OR gate 752, consisting of all of the Q outputs 757, and control line A>B, i.e., line 749, are low the output line 755 of OR gate 752 is only then low and makes one input of AND gate 762 low thus blocking the clock pulses from line 706 from reaching the clock input of counter 751. At the same time inverter 753 sets line 756 high thus clearing flip-flop 754 and clearing output line 758 from the counter block.

The net result of this is that an "object" will not be "recognized" at a particular sensor until it has been "seen" N times and will not be cleared until it has "not been seen" N times after first being "recognized". This prevents random fluctuations, transients, spurious events, and noise from providing erroneous readouts.

Figure 5:
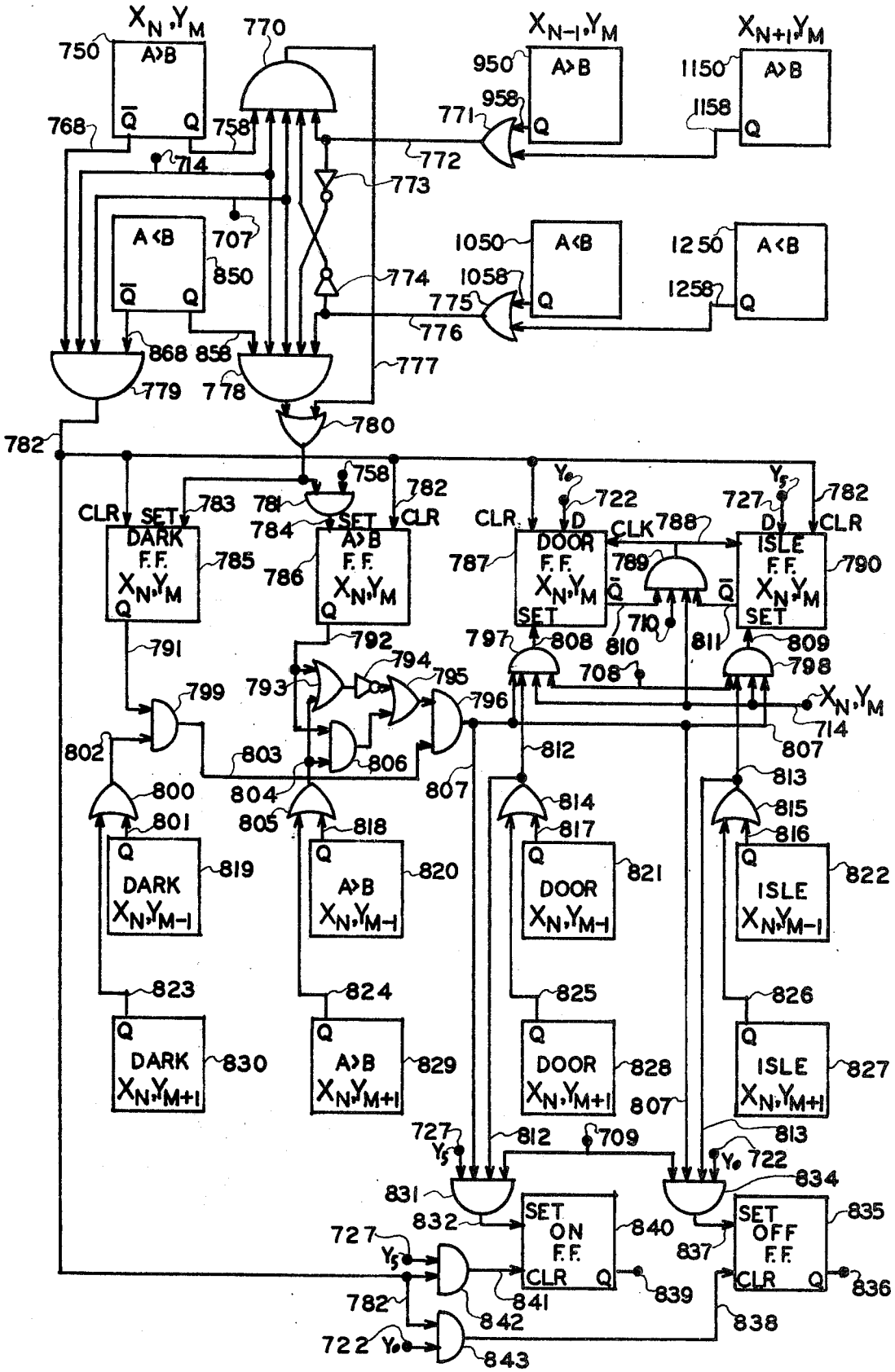

Once an object is "recognized" at one sensor it is desirable to determine if it is consistent with objects "recognized" at neighboring sensors. Accordingly, the logic block 450 is preferably provided with a verification circuit for carrying out this function as shown in FIG. 5. FIG. 5 shows counter blocks 750 and 850 for sensor position $X_n$, $Y_m$ as well as counter blocks 950 and 1050 for position $X_{n-1}$, $Y_m$ and counter blocks 1150 and 1250 for position $X_{n+1}$, $Y_m$ for A>B and A<B respectively. AND gate 770 will give a high indication on line 777 if and only if the output line Q, 758 of counter block 750 is high and there is a high on one or both Q lines of counter blocks 950 or 1150 for A>B when the $X_n$, $Y_m$ line 714 is high and there is a pulse on line 707 from sequencer 702 and there is not a high on either Q line from counter blocks 1050 or 1250 for A<B as transmitted by inverter 774.

Alternatively, if Q lines 858 of counter block 850 for A<B, is high rather than line 758 and there is a high on one or both Q lines 1058 or 1258 of counter block 1050 or 1250 for A<B and the same lines 714 and 707 are high and there are no highs on lines 1158 or 958 for counter blocks 950 or 1150 as indicated by inverter 773 then AND gate 778 will give a high output to OR gate 780. In other words there must be a correlation between position $X_n$, $Y_m$ with at least one of the nearest neighbors in the X direction and that correlation must be data of the same direction of A>B or A<B. If these conditions are met, a pulse originating from line 707 will be outputted on line 783 from OR gate 780 to set the DARK flip-flop 785 for position $X_n$, $Y_m$.

This stores in memory the fact that an object is "recognized" and is consistent with objects "recognized" by its neighbors. At the same time line 783 is an input to AND gate 781 and if the observed condition in sensor position $X_n$, $Y_m$ is A>B, flip-flop 786 will be set to note the polarity of change in light that the object produced. If at that point in time there were no outputs either of A>B or A<B for position $X_n$, $Y_m$, lines 768 and 868 would be high and a pulse from line 707 would be transmitted through AND gate 779 to output line 782 to clear all of the flip-flop storage registers 785, 786, 787 and 790 for sensor position $X_n$, $Y_m$. The result of the pulse on line 707 is to store the fact that an object is seen at the dark flip-flop 785, and on the polarity of change, A>B flip-flop, 786.

The point of origin and the direction of travel of the object must be determined and accordingly, logic block 450 provides means for making this determination. For this, correlations are made with sensors in the Y direction. If sensor position $X_n$, $Y_m$ is not at the edges of the array such as at the door or aisle, then to a valid observible object it must have moved there from a nearest neighbor in the Y direction. AND gate 799 compares the output of the DARK flip-flop 785 for sensor position $X_n$, $Y_m$ with DARK flip-flops 819 and 830 for position $X_n$, $Y_{m-1}$ and $X_n$, $Y_{m+1}$ respectively, giving a high indication on line 803 if there is a correlation. Or gates 793 and 795, AND gate 806 and inverter 794 correlate the output of A>B flip-flop 786 for position $X_n$, $Y_m$ with outputs from flip-flops 820 and 829 for position $X_n$, $Y_{m+1}$ and $X_n$, $Y_{m+1}$ respectively. If output from 786 is high then either 818 or 824 must be high to correlate. If output from 786 is low then either 818 or 824 must be low to give a valid correlation or a high on the output line of OR gate 795.

If there is both a correlation of DARK flip-flops and A>B flip-flops for $Y_m$ and at least one of its nearest neighbors, output line 807 from AND gate 796 will go high. If the sensor select line 714 is high the condition of either the DOOR flip-flops 821 and 828 or AISLE flip-flops 822 and 827 for Y position $m-1$ or $m+1$ respectively will be transmitted through the AND gates 797 or 798 to set the DOOR flip-flop or AISLE flip-flop for position $X_n$, $Y_m$ with the information carried by them when a pulse arrives on line 708 from sequencer 702. This operation carries along to the most recent sensor position in which the object is seen information about the point of origin of the object when it entered the sensor area. This, in effect is a label of whether the object entered by the door or by the aisle. If there was no information stored in the DOOR or AISLE flip-flops for Y positions $m-1$ or $m+1$ then the object is either an isolated event popping up in the middle of the array to be ignored or, is a new object entering either from the door or from the aisle. The pulse on line 710 from sequencer 702 is one of the inputs to AND gate 789 and if lines 810 and 811 are high indicating no information had been entered in the flip-flops 787 or 790, with clock pulse 708 a clock pulse will be be transmitted to line 788 to clock in data from line 722 or 727. Line 722 is for the $Y_0$ or door row output from the Y sequencer 721 and line 727 is for the $Y_5$ or aisle row output from Y sequencer 721. This would then set into the memory register the source of the object entering from either the door or the aisle.

If an object had originated at the door and had progressed through a sequence of positions in Y until it arrived at the row of sensors for the aisle, AND gate 831 would have all the input conditions high to set the ON flip-flop 840 when the pulse on line 709 from sequencer 702 goes high. By the same token if an object had originated at the aisle and progressed through the sensor array arriving at the door or at row $Y_0$, all the conditions would be met to set the OFF flip-flop 835 with the same pulse on line 709. With either the ON flip-flop 840 or the OFF flip-flop 835 set, the ON or OFF event is not counted until these flip-flops are cleared by lines 841 or 838 respectively when the object has finally cleared the border row. This is accomplished by line 782, the clear line for the register flip-flops 785 through 787 and 790 which goes high when the sensor position is finally cleared. AND gate 842 will clear the ON flip-flop if the object has cleared the aisle row $Y_5$ indicated by a high on line 727. By the same token the OFF flip-flop 835 will be cleared when the object clears the door row $Y_0$ indicated by a high on line 722. The outputs from the ON flip-flop 840 or OFF flip-flop 835, lines 839 and 836 respectively are used to increment the respective counters for the total number of "on" or "off" events.

In a preferred embodiment unit 400 would be mounted above the objects looking down into the field of determination as depicted in FIG. 2. As described, the logic unit 450 would periodically determine (1) the presence and number of objects remaining in the field of determination; (2) the number of objects that have entered and exited in one direction; and (3) the number of objects that have entered and exited in the opposite direction. This information is periodically transmitted to the data storage unit 470 via conductor 466, along with other information periodically acquired on auxiliary data lines represented by conductors 467–469 and there recorded in a convenient form for later retrieval. Such recording means could be a magnetic tape recorder or programmable read only memory.

At times when it is determined that there are no objects 406 within the field of determination 500, the auxiliary sensor 401 is interrogated and the "present" value of light arriving at the sensor is compared with the last "normal" value stored in memory 460 to determine whether there has been a change in the general ambient light conditions for the field of determination. When it is determined that a change in the ambient conditions has occurred the output from the array of sensors is again "polled" and their corresponding "present" values stored memory units 460 replacing the former values of the "unoccupied" light levels. This can be a continuing proces except in most cases when an object is present in the field of determination. The sensor unit 401 is aimed at an area of determination having similar ambient illumination as the rest of the field of determination 500 but in a location where objects do not pass through its area of determination. It is the incorporation of the auxiliary sensor that continually readjusts the "normal ambient" illumination levels for the field of determination that provides this sensor/counter unit with one of its novel features fulfilling an important object of this invention and allowing it to be operated over an extremely wide range of ambient light conditions. A further important advantage of this continually updating or adjusting system is that a wide range of performance of the sensors, both "as supplied" and "as aged", is tolerated since operation is continually adjusted to "present" performance conditions as a standard for comparison during interrogation.

In one embodiment lenses 121–127, 131–137 through 181–187 were acquired having a focal length of 21mm. and having four edges flattened to make them square with edges of 15mm. in length. Forty-nine of these lenses were cemented together edge to edge with an epoxy resin cement with a setting time of five minutes to make an array as 100 in FIG. 1. An array of 32 lights was set up to correspond to 32 separate areas to be sensed in the complete field of determination. The lenses focused these lights on a film plate placed at the focal plane of the lenses. Development of this film plate indicated the placement of 32 photosensors. A printed circuit board was etched to secure the 32 sensors using the photographic plate as a guide to determine their placement using conventional photo-etching circuit board techniques known to those skilled in the art. Light absorbing baffles were arranged in an array 300 so that light originating from one area of determination would not be focused by a lens onto any sensor other than the primary sensor for that area of determination. In other words, the baffles maintain a one-to-one relationship between sensors and areas of determination. Photo-darlington light sensors 2N577 were placed at the thirty-two sensor locations, 221–226, 231–236, 241–246, 251–256, 261–266, 281–287 of array 200. Thirty of the 32 sensors were interrogated by the logic circuit at regular intervals to determine the existence and motion of objects. Sensors 281 and 287 at the corners were used to determine changes in overall ambient actinic radiation for the field of determination, their areas of determination being outside of the area where the objects to be detected were allowed. Periodically the level observed by these sensors was compared with the last stored value to determine if ambient conditions had changed for the total area of determination. At any time such a change was sensed all sensors were "polled" for the purpose of setting new values of "normal" ambient light reaching each sensor and their values stored in a memory 460. NS 3900 operational amplifiers set to have a voltage gain of about 5:1 were used to amplify the signals from the photodarlingtons as per 411–417 of FIG. 2.

In another embodiment molds were made of the lens array described in the first embodiment using latex molding compound and plaster of paris. A clear acrylic molding compound such as used for embedding objects for decorative purposes was poured into the empty molds and allowed to cure. The resulting acrylic plastic sheet contained 49 molded, double-convex lenses with a focal length of 15mm. The process then proceeded as the above example.

It will be understood that the lenses may be made of any suitable materials such as plastic, acrylic, glass, quartz, etc., shaped suitably to concentrate ambient light from discrete areas of the field of determination onto the sensors. It will also be understood that the sensors may be one of a plurality of types such as photocells, photo-batteries, photo-resistors, photo-diodes, photo-transistors, photo-darlington amplifiers, charged coupled device photo-sensors, vidicons, orthocons, etc., to detect actinic radiation. Amplifiers or amplification means and logic may be of conventional silicon or germanium transistors, etc., and TTL, DTL, MOS, CMOS, RTL, etc, or may be microprocessors of various types of manufacture.

Though the operation of the sensor device has been described in terms of a plane of interest it is to be understood that in an embodiment of the invention each sensor may actually observe or monitor a cone of interest starting at the lens and expanding down through the field of determination so that in fact objects passing anywhere within the cone of observation my be sensed and counted. This implies of course that not only objects standing or moving on one plane may be observed and counted but so also may objects on other planes so that a 3-dimensional space may be observed and objects counted.

Though an ideal or preferred embodiment of this device is a compact array consisting of matrix of sensors and lenses in a regular pattern and contained in a homogeneous unit of compact size as described in the description of the preferred embodiments, it is to be understood that for the purposes of this invention the individual sensors together with their lens and enclosure/spacer may be separated from each other by reasonable distances and may be in a totally non-uniform pattern or arrangement and may be aimed independently to observe specific areas of interest which may also be widely separated and reasonably unrelated to each other. As an example in another practical embodiment these sensors and their lenses and enclosure/spacers may be distributed along the length of pieces of tape such that they may be secured to a bulkhead, wall, ceiling, or whatever.

In satisfying one of the objects of the invention it is understood that no incident beams of any kind are required to produce the desired effect, but rather that ambient conditions or ambient illumination may be sufficient.

It is to be further understood that in the definition of ambient conditions are included objects which in themselves give off some form of radiation. For example, visible, ultraviolet, infrared light, X-rays, ultrasonics, or microwave radiations, etc. For example, persons emitting infrared radiations may be observed by the device described in total darkness and will thus satisfy an object of this invention. In one embodiment the use of infrared filters would be interspersed in the optical system between the observed object and the sensor to exclude light as might be reflected by objects of all types whether alive or not. For example, this would allow the sensor unit to observe and count only living objects that produce more than the normal ambient infrared radiation and exclude briefcases, shopping bags, purses, etc. In this configuration a more discerning and discriminating device can be produced.

It is to be further understood that the sources of infrared radiation may be flames or fire as in fire alarm systems or sources of heat such as furnaces, hot plates, ovens, and the like. The latter application may be for instance monitoring of appliances or laboratory equipment for safety reasons.

Though in a preferred embodiment a device with a seven by seven matrix array has been described it is to be understood that for purposes of this invention a minimum of two such sensor units consisting of lens, spacer, container, and sensor may be used to satisfy one or more objects of this invention. It is to be further understood that there is no upper limit to the number of sensors except as dictated by the constraints of producing a practical device.

The cones of observation for purposes of the present invention may be either non-overlapping or slightly overlapping providing a separation of events occurring in the former case and a continuity of events in the latter case. There is always the possibility of the confusion of two objects when the locus of their movements collide in such a way that they are both in part observed by the same sensor providing in some cases a possible ambiguity in the emerging loci as to which converging loci are connected to which emerging loci. A modification of the present device which may clarify and separate the results of such an ambiguity is by the method of determining the rate of movement or speed of the objects before the point of ambiguity and relating them to the rates of movement or speed of the objects after the point of ambiguity. The logic module 450 could be used to calculate these rates of motion from information obtained from the sensor array and can be used to enhance the accuracy of the counter system.

While the invention has been described in its preferred embodiment it is to be understood that the words which have been used are words of description rather than limitation and that changes may be made within the purview of the appended claims without departing from the true scope and spirit of the invention in its broader aspects.

What is claimed is:

1. An apparatus for detecting the number of objects traversing a given path having a first and a second boundary comprising:

a plurality of discrete light sensors adjacent to one another and positioned adjacent and along said path for sensing the ambient light in said path, at least a first of these sensors for sensing ambient light at said first boundary and a second for sensing ambient light at said second boundary, a scanner for periodically sampling the output of each of said sensors, a first memory, the output of said scanner being connected to said memory to store therein the present outputs of each sensor as it is scanned, a second memory connected to said first memory for storing the past outputs of each sensor, a comparator for comparing the stored present outputs with the stored past outputs for each sensor whereby changes in said ambient light caused by the presence of said objects in said path are detected, a means for detecting movement of said objects along said path comprising a means for comparing the detected changes in ambient light at one sensor with detected changes at adjacent sensors along said path, a means responsive to said first and said second sensors and responsive to said detecting means for determining if a detected moving object has traversed both of said boundaries, and a means responsive to said determining means for recording each such traversal.

2. The apparatus of claim 1 further comprising a means for preventing erroneous readouts, said means comprising:

a means for determining whether said detected changes in ambient light exceed a preset value.

3. The apparatus of claim 2 wherein said means for determining whether said preset value has been exceeded comprises:

a counter responsive to said comparator for counting the number of present outputs which are different from the stored past outputs for each sensor and wherein said changes in ambient light are disregarded as indicating the presence of objects in said path unless said counter exceeds said preset value.

4. The apparatus of claim 2 wherein said means for preventing erroneous readouts further comprises:

a verification circuit for determining whether detected changes in ambient light at a particular sensor are detected at adjacent sensors located across said path.

5. The apparatus of claim 2 wherein each comparator produces a first signal indicating that the present output is less than the past output and produces a second signal when said present output is greater than said past output.

6. The apparatus of claim 5 wherein said means for determining whether said preset value has been exceeded comprises:

a counter for each sensor responsive to said first signal; and a counter for each sensor responsive to said second signal whereby changes in said ambient light are disregarded unless either counter exceeds said preset value.

7. The apparatus of claim 6 wherein said means for determining if said boundaries are traversed comprises:

a third memory responsive to said counters, whereby a traversal is recorded whenever said third memory responds to counters of both of said first and said second sensors and to said means for detecting movement between said first and said second sensors.

8. The apparatus of claim 1 wherein said apparatus further comprises:

an auxiliary light sensor for sensing the ambient light in a portion of said path where said objects do not pass, and a means for periodically substituting the output of said auxiliary sensor for said stored past outputs in said memory.

9. The apparatus of claim 1 wherein said plurality of said light sensors are positioned above said path.

* * * * *

UNITED STATES PATENT AND TRADEMARK OFFICE

CERTIFICATE OF CORRECTION

PATENT NO. : 4,127,766

DATED : November 28, 1978

INVENTOR(S) : Stephen C. Thayer

It is certified that error appears in the above-identified patent and that said Letters Patent are hereby corrected as shown below:

Col. 5, line 48, after "converter", delete "400" and insert therefor --440--;

Col. 6, line 38, after "determine", delete "()" and insert therefor --(1)--;

Col. 10, line 8, delete "to a" and insert therefor --to be a--;

Col. 12, line 8, after "sensors" delete "2N577" and insert therefor -- 2N5777--;

" line 26, after "from the" delete "photodarlington" and insert --photo-darlington--;

" line 57, after "observation" delete "my" and insert therefor --may--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*